US006915742B2

(12) United States Patent
Senoo et al.

(10) Patent No.: US 6,915,742 B2
(45) Date of Patent: Jul. 12, 2005

(54) BLANKET WASHING METHOD AND BLANKET WASHING SOLUTION REMOVING METHOD FOR USE IN WEB OFFSET PRINTING PRESS

(75) Inventors: Shinichiro Senoo, Hiroshima-ken (JP); Yoshinori Nakaya, Hiroshima-ken (JP); Shigehiro Fujii, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/252,824

(22) Filed: Sep. 24, 2002

(65) Prior Publication Data

US 2003/0066450 A1 Apr. 10, 2003

(30) Foreign Application Priority Data

Sep. 26, 2001 (JP) ..... 2001-293505
Dec. 21, 2001 (JP) ..... 2001-389893

(51) Int. Cl.[7] ..... B41F 35/00
(52) U.S. Cl. ..... 101/424; 101/483
(58) Field of Search ..... 101/483, 423, 101/424, 425; 15/256.52, 256.51; 134/9, 18, 153, 156, 165

(56) References Cited

U.S. PATENT DOCUMENTS 4,686,902 A * 8/1987 Allain et al. ..... 101/424
5,097,764 A * 3/1992 Waizmann ..... 101/425
5,303,652 A * 4/1994 Gasparrini et al. ..... 101/425
5,447,102 A * 9/1995 Pfeiffer et al. ..... 101/492
5,553,546 A * 9/1996 Hoff ..... 101/483
5,584,245 A * 12/1996 Schonberg ..... 101/484
5,740,030 A * 4/1998 Ottl et al. ..... 700/9
6,019,039 A * 2/2000 Knauer et al. ..... 101/218
6,055,907 A * 5/2000 Endisch et al. ..... 101/484
6,109,182 A * 8/2000 Vestman et al. ..... 101/483
6,408,747 B2 * 6/2002 Koppelkamm et al. ..... 101/147

FOREIGN PATENT DOCUMENTS

| | | |
|---|---|---|
| JP | 3-27024 | 4/1991 |
| JP | 6-182962 | 7/1994 |
| JP | 6-320714 | 11/1994 |

* cited by examiner

*Primary Examiner*—Anthony H. Nguyen
(74) *Attorney, Agent, or Firm*—Armstrong. Kratz, Quintos Hanson, & Brooks, LLP.

(57) ABSTRACT

A blanket cylinder washing method for use in a web offset printing press. A blanket cylinder is rotated independently of running of a web, with the blanket cylinder thrown off, preferably, the blanket cylinder is rotated at a speed $V_1$ higher than a running speed $V_0$ of the web, and the blanket cylinder is washed. It is thereby possible to decrease the amount of spoilage generated when the blanket cylinder is washed.

21 Claims, 13 Drawing Sheets

BLANKET WASHING METHOD AND BLANKET WASHING SOLUTION REMOVING METHOD FOR USE IN WEB OFFSET PRINTING PRESS

BACKGROUND OF THE INVENTION (1) Field of the Invention

The present invention relates to a web offset printing press, particularly, to a blanket washing method, and a blanket washing solution removing method after washing for use in a web offset printing press of a shaftless type.

(2) Description of Related Art

In a web offset printing press, a pattern is once transferred from a machine plate of a plate cylinder onto a blanket mounted on the outer peripheral surface of a blanket cylinder, then printed on a web from the blanket. Continuous printing allows residue of ink to attach to the blanket. When the quantity of the residual ink increases, this adversely affects on the printing quality of products. For this, when a certain number of sheets are printed, the printing is once stopped, the blanket cylinder is thrown off to wash the blanket (hereinafter referred as blanket wash). When the plate is changed and the printing is resumed with a new plate, it is necessary to remove a pattern of the old plate from the blanket. When the plate is changed, blanket wash is carried out, as well. Blanket wash is generally performed by rotating the blanket cylinder while it is thrown off and supplying a washing solution to the blanket.

A web offset printing press generally comprises, as shown in FIG. 17, a feeding unit 2 having a web roll 1, an infeed unit 3 drawing out a web (strip-like paper) from the web roll 1, printing units 4 including a plurality of printing units 4*a* through 4*d* each having the above plate cylinder, the blanket cylinder, etc., a drier unit 5 applying heat onto the web 10, on which printing has been performed, to dry it, a cooling unit 6 cooling the heated web 10, a web pass unit 7, and a folder 8 processing the strip-like web 10 into signatures, as essential parts. Heretofore, a web offset printing press of a line-shaft type (shaft machine) is general, in which driving units of the infeed unit 3, the printing units 4*a* through 4*d*, the cooling unit 6, the web pass unit 7 and the folder 8, etc. are connected to a main motor 11 through a common line shaft 12, and the driving units are integrally driven under a driving control on the main motor 11 by a control unit 15.

In such a shaft machine, the printing units 4*a* through 4*d* are connected to the infeed unit 3 making the web 10 run and the cooling unit 6 by the line shaft 12, so that the printing units 4*a* through 4*b* rotate at a speed equal to the running speed of the web 10. When blanket wash is carried out, the web 10 runs at a speed equal to the peripheral speed of the blanket cylinder. During which, the web 10 becomes all spoiled, because no printing is, of course, carried out.

Heretofore, before printing is started, the printing press is driven at a slow-operating speed (preferably the minimum speed) to decrease the run length of the web 10, thereby suppressing generation of spoilage. When blanket wash is carried out during printing, the current printing speed is reduced to a certain extent, and blanket wash is carried out. After completion of the washing, the speed is again increased to the printing speed, and the printing is resumed. Whereby, the run length of the web 10 during the blanket wash is decreased, thereby suppressing generation of spoilage.

Recently developed was a web offset printing press (shaftless machine) of a shaftless type (separately driving type) without a conventional line shaft, in which, as shown in FIG. 18, drive motors 24*a* through 24*d*, 23, 26, 27 and 28 are provided to respective driving units such as printing units 4*a* through 4*d*, an infeed unit 3, a cooling unit 6, a web pass unit 7, a folder 8, etc. In this shaftless machine, control units 34*a* through 34*d*, 33, 36, 37 and 38 are provided correspondingly to the respective drive motors 24*a* through 24*d*, 23, 26, 27 and 28. The drive motors 24*a* through 24*d*, 23, 26, 27 and 28 are electrically synchronized and operated under synchronous controls of the control units 34*a* through 34*d*, 33, 36, 37 and 38.

Also developed was a web offset printing press of another type, in which only printing units 4*a* through 4*d* are connected by a line shaft 22 and integrally driven by a drive motor 24 through the line shaft 22, and drive motors 23, 26, 27 and 28 are respectively provided to another driving units such as an infeed unit 3, a cooling unit 6, a web pass unit 7, a folder 8, etc., as shown in FIG. 19. In a web offset press of this type, control units 33, 34, 36, 37 and 38 are provided correspondingly to the respective drive motors 23, 24, 26, 27 and 28, and the drive motors 23, 24, 26, 27 and 28 are electrically synchronized and operated under synchronous controls of the control units 33, 34, 36, 37 and 38. Since web offset printing presses of this type are basically of a shaftless type although having a line shaft in part, the web offset printing presses show in FIGS. 18 and 19 will be generally referred as shaftless machines, hereinafter. Blanket wash can be carried out in the known manner as above in these shaftless machines, as a matter of course. Actually, blanket wash is carried out in the shaftless machines just as done in shaft machines.

However, it is necessary in the known manner to decrease the peripheral speed of the blanket cylinder synchronized with the running speed of the web 10, that is, the washing speed during the blanket wash, in order to decrease the run length of the web 10. This causes degradation of the effect of washing, or causes a longer washing time, resulting in an increase in run length of the web 10, and an increase in amount of spoilage. For this, there are requirements for more effective blanket wash, and for improvement in the productivity by decreasing the amount of spoilage generated at the time of blanket wash as much as possible. Particularly, shaftless machines have characteristics that the printing units can be driven independently of other driving units, so that it is desired to solve the above problems while making the best use of the characteristics of the shaftless machines.

A gap is generally formed in the blanket cylinder to catch a blanket therein, whereby the blanket is wound around the blanket cylinder. However, the washing solution enters in the gap at the time of blanket wash. The washing solution in the gap flies out by centrifugal force according to the peripheral speed of the blanket cylinder. When the operation is resumed, the web is contaminated by the washing solution flying out from the gap of the blanket cylinder for a while after the web has reached the printing speed. Printed matter printed during this has a high probability that contamination by the washing solution is attached thereon, thus being generally treated as spoilage from the viewpoint of the printing quality. This is also a common problem among the known shaft machines and shaftless machines. There is thus a demand to decrease the amount of spoilage caused by the washing solution after the blanket wash to improve the productivity.

SUMMARY OF THE INVENTION

In the light of the above problems, an object of the present invention is to provide a blanket washing method for use in a web offset printing press, by which a blanket can be efficiently washed, and the amount of spoilage generated when the blanket is washed can be decreased.

Another object of the present invention is to provide a blanket washing solution removing method for use in a web offset printing press, by which a washing solution having entered in a gap of a blanket cylinder can be efficiently removed, and the amount of spoilage generated after printing has been resumed can be decreased.

In order to accomplish the former object, the present invention provides a blanket washing method on the condition that a web offset printing press which can control separately the running speed of a web and the rotation speed of a printing unit is used therein.

In a blanket washing method according to this invention, a blanket cylinder of a printing unit is thrown off, and a blanket mounted on a surface of the blanket cylinder is washed while the blanket cylinder is operated at a peripheral speed differing from the running speed of the web. In order to decrease the amount of generated spoilage, it is essential that the peripheral speed of the blanket cylinder is increased to improve the washing efficiency to shorten the washing time, and the running speed of the web is decreased to shorten the run length of the web. By washing the blanket while the blanket cylinder is operated at a peripheral speed differing from the running speed of the web as above, it becomes possible to set the peripheral speed of the blanket cylinder and the running speed of the web to speeds suited to provide efficient washing and to decrease the amount of generated spoilage.

Preferably, the blanket is washed while the blanket cylinder is rotated at a peripheral speed higher than the running speed of the web. Heretofore, the peripheral speed of the blanket cylinder is equal to the running speed of the web, so that the run length of the web becomes longer when the peripheral speed of the blanket cylinder is increased to shorten the washing time, or the washing time of the blanket becomes longer when the run length of the web is shorten by decreasing the running speed of the web. In either case, it is difficult to decrease the amount of spoilage. By rotating the blanket cylinder at a peripheral speed higher than the running speed of the web as above, it is possible to shorten the washing time without increasing the run length of the web, or shorten the run length of the web without increasing the washing time of the blanket, and decrease the amount of spoilage compared with the former.

When the above washing method is applied to washing of the blanket at the time of a start of printing, the following method is preferable. During a course of increasing the running speed of the web from a stopping state to a predetermined stand-by speed or after the running speed has been increased, the blanket cylinder is thrown off, the blanket is washed while the blanket cylinder is rotated at a predetermined washing speed higher than the stand-by speed, the peripheral speed of the blanket cylinder is reduced to the stand-by speed after the blanket has been washed, the blanket cylinder is thrown on, and the running speed of the web is increased to a predetermined printing speed. By carrying out the washing in the above method, it is possible to improve the washing efficiency of the blanket to shorted the washing time, and decrease the amount of spoilage generated when the washing is carried out at the time of a start of printing. Preferably, the above stand-by speed is set to a slow-operating speed, more preferably, to a minimum running speed of the web.

When the above washing method is applied to washing of the blanket cylinder during printing, the following method is preferred. During a course of reducing the running speed of the web from a predetermined printing speed to a predetermined stand-by speed, the blanket cylinder is thrown off, the blanket is washed while the blanket cylinder is rotated at a predetermined washing speed higher than the stand-by speed, the peripheral speed of the blanket cylinder is synchronized with the running speed of the web after the blanket has been washed, the blanket cylinder is thrown on, and the running speed of the web is again increased to the printing speed. Alternatively, the running speed of the web is increased while the peripheral speed of the blanket cylinder is synchronized with the running speed of the web after washing has been completed, and the blanket cylinder is thrown on when the speeds are synchronized, or at the printing speed. By carrying out the washing in the above method, it is possible to feed the web at a low speed to shorted the run length thereof during the washing while the blanket cylinder is rotated at a high peripheral speed, thereby keeping the washing efficiency at a high level, and decrease the amount of spoilage generated when the washing is carried out during printing.

When the blanket is washed before printing is started or during printing, the blanket is washed in the above method. After the blanket has been washed, it is preferable to add a step of rotating the blanket cylinder at a peripheral speed higher than a peripheral speed at the time of washing before the blanket cylinder is thrown on to remove a washing solution attached to the blanket. By rotating the blanket cylinder at a peripheral speed higher than the peripheral speed at the time of washing, it is possible to remove a washing solution having entered in a gap of the blanket cylinder by centrifugal force, thereby decreasing the amount of spoilage generated after the printing is resumed. Whereby, the above former and latter objects can be accomplished.

When the above washing method is applied to washing of the blanket cylinder after completion of printing, the following method is preferable. During a course of reducing the running speed of the web from a predetermined printing speed to a stopping state, the blanket cylinder is thrown off, the blanket is washed while the blanket cylinder is rotated at a predetermined washing speed, and the peripheral speed of the blanket cylinder is reduced to the stopping state after the blanket has been washed. By carrying out the washing in the above method, it is possible to rotate the blanket cylinder at a high peripheral speed while the speed of the web is reduced, thereby keeping the washing efficiency at a high level, and decreasing the amount of spoilage generated when the washing is carried out after completion of printing.

In this case, preferably, the running speed of the web is reduced to a predetermined stand-by speed (a slow-operating speed, preferably, a minimum running speed) after the blanket cylinder has been thrown off, and the running speed of the web is reduced to a stopping state after the blanket has been washed. By slowing operating the web without stopping the web during the blanket washing, it is possible to prevent the washing solution from attaching to the same portion of the web, and prevent the web from breaking.

The blanket washing method according to this invention can provide a larger effect by providing a pair of guide means disposed on an upper stream side and a lower stream side of the blanket cylinder in the running path of the web to change the course of the running path of the web. A running path of the web is changed by the guide means to reduce or get rid of a contact of the web with the blanket cylinder when the blanket cylinder is thrown off and the blanket is washed while the blanket cylinder is rotated at a peripheral speed differing from the running speed of the web. When the guide means is provided as above, there is less possibility of paper breaking when the blanket is washed, so that feeding of the web may be stopped.

Depending on the type of the web offset printing press, it is possible to giving a tension to the web to clamp the same, and wash the blanket while the blanket cylinder idles with respect to the web.

The present invention also provides a web offset printing press and a control program for realizing the above blanket cylinder washing method. According to the present invention, a web offset printing press being able to separately control a running speed of a web and a rotation speed of a printing unit comprises a control unit for automatically operating a whole of the printing press to wash a blanket of the printing unit in the above blanket washing method. A control program (first control program) according to the present invention is a program executable in a computer for controlling a web offset printing press, which can separately control a running speed of a web and a rotation speed of a printing unit. The control program is executed in the computer for controlling to automatically operate a whole of the printing press to wash a blanket in the above blanket washing method.

In order to accomplish the latter object, the present invention provides a blanket washing solution removing method on condition that a web offset printing press which can separately control a running speed of a web and a rotation speed of a printing unit is used therein.

A blanket washing solution removing method of the present invention comprises the steps of operating a blanket cylinder at a peripheral speed differing from the running speed of the web with the blanket cylinder thrown off after a blanket mounted on a surface of the blanket cylinder of the printing unit has been washed to remove a washing solution attached to the blanket. The blanket cylinder is rotated to remove a washing solution attached to the blanket cylinder (particularly, in a gap) by centrifugal force. By rotating the blanket cylinder independently of feeding of the web, it is possible to set the peripheral speed of the blanket cylinder to a speed suitable to remove the washing solution, and decrease the amount of generated spoilage.

Preferably, the blanket cylinder is rotated at a peripheral speed higher than the running speed of the web to remove the washing solution attached to the blanket. Since the washing solution flies out from the gap according to the peripheral speed, the blanket cylinder is rotated at a peripheral speed higher than the running speed of the web to remove the washing solution. Even when the blanket cylinder is thrown on, the washing solution does not fly out from the gap so long as the running speed of the web does not exceed the peripheral speed of the blanket cylinder, so that contamination of the web by the washing solution, that is, generation of spoilage, can be prevented. More preferably, the blanket cylinder is rotated at a peripheral speed higher than a maximum peripheral speed at the time of printing to remove the washing solution attached to the blanket cylinder. Whereby, the washing solution does not fly out from the gap during printing, and contamination of the web by the washing solution, that is, generation of spoilage, can be prevented highly probably.

In this case, it is preferable that the web is slowly fed at a predetermined stand-by speed. By slowly operating the web without stopping the same, it is possible to prevent the washing solution from attaching to the same portion of the web, and the web from breaking. When printing is started or when printing is resumed, a drier temperature increasing process of increasing a temperature of a drier unit while the web is fed at a predetermined stand-by speed is performed. Preferably, a process of removing the washing solution attached to the blanket is performed in parallel to the drier temperature increasing process. By carrying out the process of removing the washing solution in parallel to the drier temperature increasing process, it is possible to shorten the preparation time before printing is started, and decrease the amount of spoilage generated during the preparation time.

The blanket washing solution removing method of the present invention can provide a larger effect by providing a pair of guide means on an upper stream side and a lower stream side of the blanket cylinder in the running path of the web to change the course of the running path of the web. When the blanket cylinder is thrown off, and the blanket cylinder is operated at a peripheral speed differing from the running speed of the web to remove the washing solution attached to the blanket, the guide means are operated to reduce or get rid of a contact of the web with the blanket cylinder. When the guide means are provided, there is less possibility of paper breaking when the washing solution is removed, so that the feeding of the web may be stopped.

Depending on the type of the web offset printing press, it is possible to give a tension to the web to make the blanket cylinder idle with respect to the web, thereby removing the washing solution attached to the blanket.

The present invention still further provides a web offset printing press and a control program for realizing the above blanket washing solution removing method. A web offset printing press (a second web offset printing press) according to the present invention, which can separately control a running speed of a web and a rotation speed of a printing unit, comprises a control unit for automatically operating a whole of the printing press to remove a washing solution attached to a blanket in the above blanket washing solution removing method. A control program (a second control program) according to the present invention is a control program executable in a computer for controlling a web offset printing press, which can separately control a running speed of a web and a rotation speed of a printing unit. The control program is executed in a computer for controlling to automatically operate a whole of the printing press to remove a washing solution attached to a blanket in the above blanket washing solution removing method.

A web offset printing press of a so-called shaftless type (separately driving type), for example, corresponds to the web offset printing press being able to separately control the running speed of the web and the rotation speed of the printing unit, to which the blanket washing method or the blanket washing solution removing method according to the present invention are applied. Even a web offset printing press of a line shaft type, it corresponds to the above web offset printing press so long as a mechanical coupling of the printing units with a relating unit group such as the in feed unit, the cooling unit, the web pass unit, folder, etc. can be released, and the printing units can be separately driven. The present invention can be applied to even a web offset printing press of a line shaft type in which the mechanical coupling among the units cannot be released so long as it has a variable speed gear between the line shaft and each unit, or a clamping means for clamping the web, with the web tensioned, although there is limitation on the employable blanket washing method or blanket washing solution removing method.

DESCRIPTION OF THE PREFERRED EMBODIMENTS

Hereinafter, description will be made of embodiments of the present invention with reference to the drawings.

(A) First Embodiment

Figure 18:
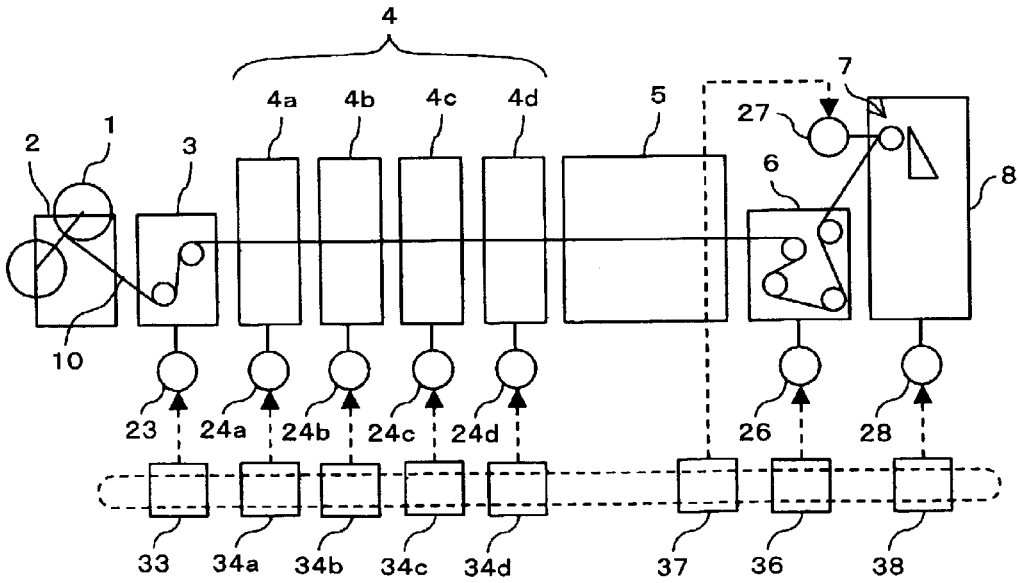
FIG. 18 is a schematic diagram showing a structure of a known web offset printing press of a shaftless type.

First, description will be made of a first embodiment of this invention with reference to FIGS. 1 and 2. Here, the present invention is applied to a conventional commercial web offset printing press of a shaftless type (hereinafter referred as a shaftless machine), and the structure of this shaftless machine is as shown in FIG. 18.

Figure 1:
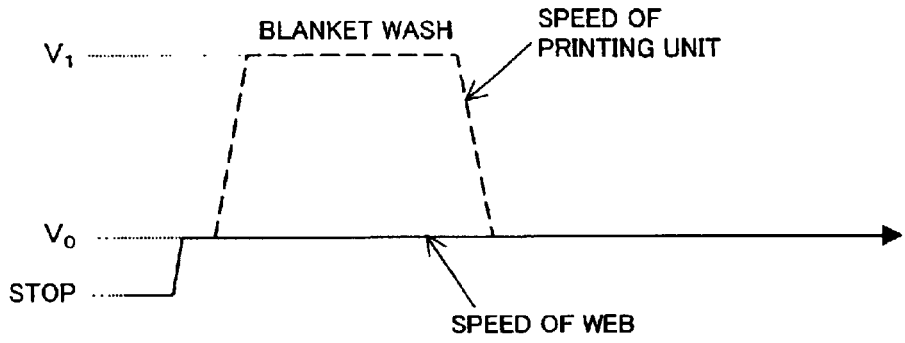
FIG. 1 is a time chart showing an operation pattern of a web offset printing press according to a first embodiment of this invention.
Figure 2:
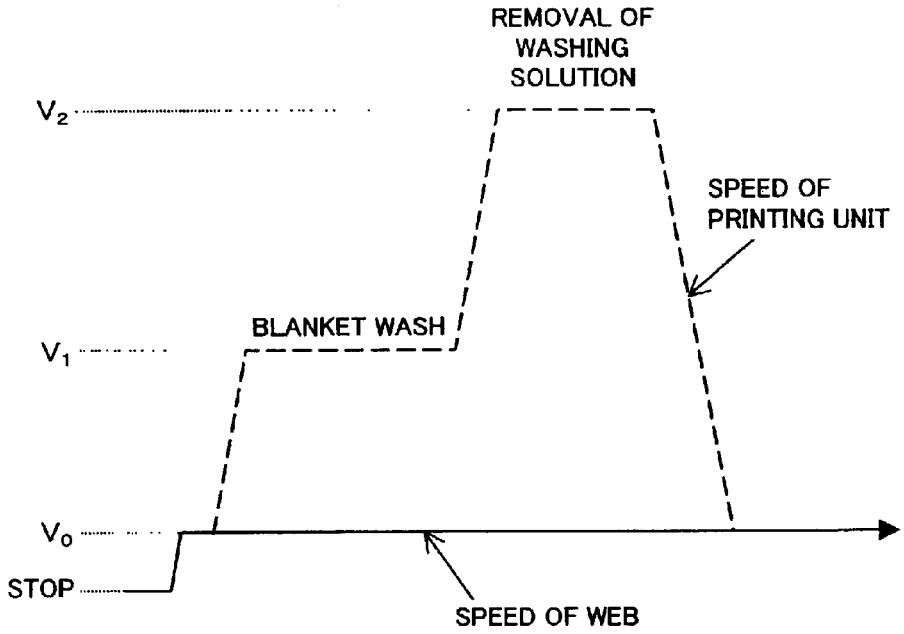
FIG. 2 is a time chart showing an operation pattern of the web offset printing press according to the first embodiment of this invention.

FIGS. 1 and 2 are time charts showing operation patterns of the shaftless machine used in blanket cylinder washing methods according to the first embodiment, wherein the rotation speed of the printing units 4*a* through 4*d* and the running speed of the web 10 are changed with time. In these drawings, the running speed of the web 10 is denoted by a solid line, whereas the rotation speed of the printing units 4*a* through 4*d* (equal to the peripheral speed of the blanket cylinder) is converted to a running speed, and denoted by a broken line. Over lapped portion of the solid line and the broken line is denoted by only the solid line. According to the first embodiment, the blanket is washed when the printing is started.

When receiving an operation start command, the control units 34*a* through 34*d*, 33, 36, 37 and 38 give commands to the respective drive motors 24*a* through 24*d*, 23, 26, 27 and 28 to drive the driving units, that is, the printing units 4*a* through 4*d*, the infeed unit 3, the cooling unit 6, the web pass unit 7 and the folder 8. As shown in FIG. 1, the running speed of the web 10 is raised from a stopping state to a predetermined stand-by speed $V_0$. The stand-by speed $V_0$ is a slow-operating speed, which is preferably set to the minimum running speed of the web 10.

When the running speed of the web 10 reaches the stand-by speed $V_0$, the rotation speed of the printing units 4*a* through 4*d* is increased to a predetermined washing speed $V_1$ with the running speed of the web 10 kept at the stand-by speed $V_0$. The washing solution is supplied, and blanket wash is carried out for a predetermined time while the rotation speed of the printing units 4*a* through 4*d* is kept at the washing speed $V_1$. Any washing speed higher than at least the stand-by speed $V_0$ suffices. The washing time is determined according to the washing speed $V_1$, so that the higher the washing speed $V_1$, the shorter the washing time is.

After completion of the blanket wash, the rotation speed of the printing units 4*a* through 4*d* is decreased to the stand-by speed $V_0$, which is the running speed of the web 10. The rotation speed of the printing units 4*a* through 4*d* is synchronized with the running speed of the web 10, and the blanket cylinder is thrown on. After register adjustment, color adjustment, etc., the running speed of the web 10 is increased to a predetermined printing speed, and printing is carried out.

It is possible to improve an effect of washing the blanket and shorten the washing time by washing the blanket in the above method, as compared with the conventional method in which blanket wash is carried out while the printing units 4*a* through 4*d* are rotated at the same speed as the running speed of the web. As a result, it is possible to shorten the run length of the web 10 and decrease the amount of spoilage generated during the blanket wash.

When the washing solution having enter in the gap of the blanket cylinder is removed after the blanket has been washed, the machine is operated in an operation pattern as shown in FIG. 2. After completion of blanket wash, the rotation speed of the printing units 4*a* through 4*d* is further increased from the washing speed $V_1$, as shown in FIG. 2. When the rotation speed of the web 10 reaches a predetermined washing solution removing speed $V_2$, the rotation speed of the printing units 4*a* through 4*d* is kept at the washing solution removing speed $V_1$, for a predetermined time. Any washing solution removing speed $V_1$, higher than at least the washing speed $V_1$, suffices. Preferably, the washing solution removing speed $V_2$ is higher than the running speed (printing speed) of the web 10 at the time of printing, more preferably, set to the maximum rotation speed of the printing units 4*a* through 4*d*. Whereby, the washing solution having entered in the gap of the blanket cylinder flies out therefrom.

After a predetermined time has elapsed, the rotation speed of the printing units 4*a* through 4*d* is decreased to the stand-by speed $V_0$, which is the running speed of the web 10, the rotation speed of the printing units 4*a* through 4*d* is synchronized with the running speed of the web 10, and the blanket cylinder is thrown on, like the case shown in FIG. 1. After register adjustment, color adjustment, etc., the running speed of the web 10 is increased to a predetermined printing speed, and printing is carried out.

It is possible to remove the washing solution having entered in the gap of the blanket cylinder by centrifugal force by rotating the blanket cylinder at a peripheral speed higher than the peripheral speed at the time of washing after completion of blanket wash. Even if the washing solution remains in the gap of the blanket cylinder, there is little possibility that the washing solution flies out from the gap so long as the peripheral speed of the blanket cylinder does not exceed the above washing solution removing speed. Accordingly, it is possible to decrease the amount of spoilage caused by the washing solution after printing is resumed.

Meanwhile, the above operation pattern can be realized in the following controlling method, for example. While the blanket cylinder is in the thrown-on state and the rotation speed of the printing units 4*a* through 4*d* is matched with the speed of the web 10, a control on the drive motors 24*a* through 24*d*, 23, 26, 27 and 28 by the respective control units 34*a* through 34*d*, 33, 36, 37 and 38 is carried out on the basis of a virtual master generated with the position of the axis of the drive motor 28 of the folder 8 as a reference. In other words, a speed synchronizing control of synchronizing the rotation speeds with the virtual master is performed on the drive motors 28, 23, 26 and 27 of the folder 8, the infeed unit 3, the cooling unit 6 and the web pass unit 7, whereas a speed synchronizing control of synchronizing the rotation speeds of and a phase synchronizing control of synchronizing the phases with the virtual master is performed on the drive motors 24*a* through 24*d* of the printing units 4*a* through 4*d*.

When the blanket cylinder is thrown off and the printing units 4*a* through 4*d* are rotated at a rotation speed differing from the speed of the web 10, the control units 34*a* through 34*d* of the printing units 4*a* through 4*d* are disconnected from the virtual master, and the control on the drive motors 24*a* through 24*d* is switched from the phase synchronizing control with the virtual master from a speed control based on a fixed target speed. When washing of the blanket and removal of the washing solution are completed, the control is switched from the speed control to the phase synchronizing control with the virtual master to bring the machine into the printable state.

Note that the above controlling method is merely one example, thus another control may be employed so long as the operations in the patterns shown in FIGS. 1 and 2 are possible. For example, two kinds of virtual master for the phase synchronizing control on the drive motors 24*a* through 24*d* of the printing units 4*a* through 4*d* may be generated. The phase synchronizing control with one virtual master may be performed when the blanket cylinder is thrown on, whereas the speed synchronizing control or the phase synchronizing control with the other virtual master may be performed when the blanket is washed or the washing solution is removed.

(B) Second Embodiment

Next, description will be made of a second embodiment of this invention with reference to FIGS. 3 and 4. A blanket washing method according to the second embodiment can be applied to a conventional commercial web offset printing press of a shaftless type, like the first embodiment, thus description will be made, referring to the printing press shown in FIG. 18 in the second embodiment.

Figure 3:
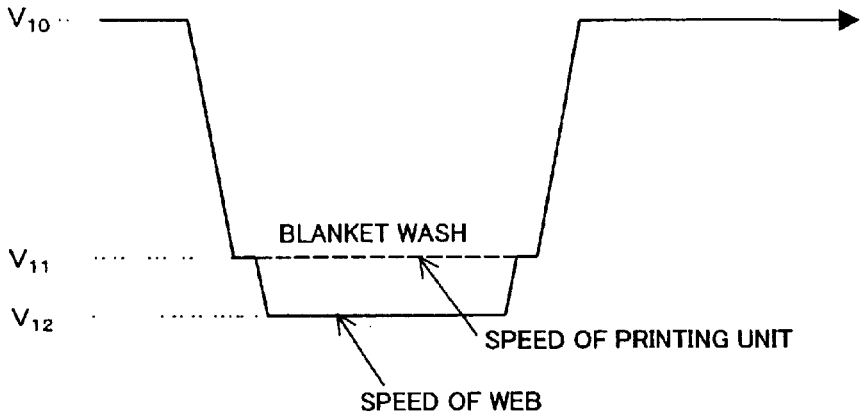
FIG. 3 is a time chart showing an operation pattern of the web offset printing press according to a second embodiment of this invention.
Figure 4:
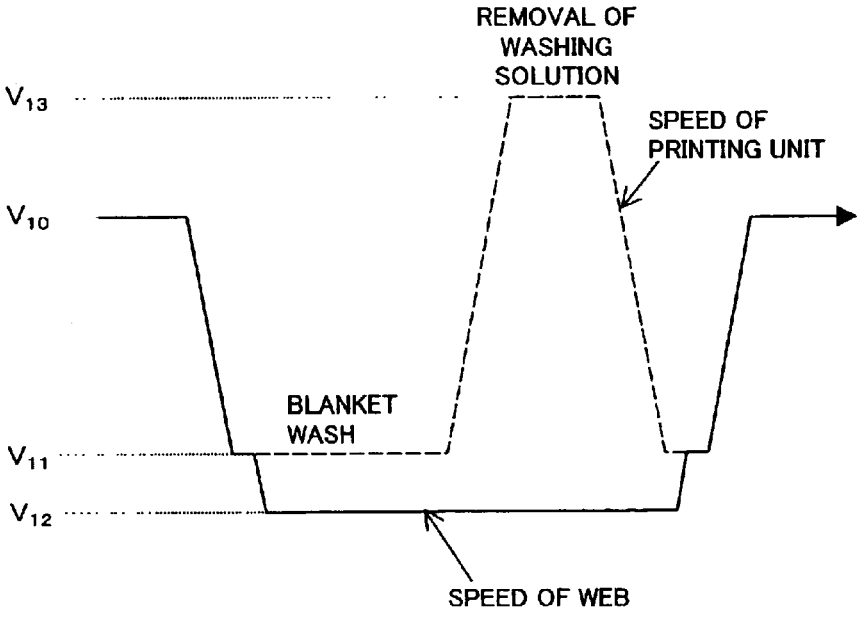
FIG. 4 is a time chart showing an operation pattern of the web offset printing press according to the second embodiment of this invention.

FIGS. 3 and 4 are time charts showing a blanket washing method according to the second embodiment, wherein the rotation speed of the printing units 4*a* through 4*d* and the running speed of the web 10 are changed with time. The running speed of the web 10 is denoted by a solid line, whereas the rotation speed of the printing units 4*a* through 4*d* is converted to a running speed and denoted by a broken line in the drawings. An overlapped portion of the sold line and the broken line is shown by only the solid line. In the second embodiment, the blanket is washed during printing.

When receiving a blanket washing command during printing, the control units 34*a* through 34*d*, 33, 36, 37 and 38 give commands to the respective drive motors 24*a* through 24*d*, 23, 26, 27 and 28 to gradually decrease the running speed of the web 10 from the printing speed $V_{10}$, as shown in FIG. 3. When the running speed of the web 10 reaches a predetermined washing speed (for example, 200 rpm) $V_{11}$, the blanket cylinder is thrown off. The washing speed $V_{11}$ may be set to the printing speed $V_{10}$ or the washing speed $V_1$ in the first embodiment, or may be set at a speed higher than these.

After the blanket cylinder is thrown off, the washing solution is supplied, and blanket wash is started while the rotation speed of the printing units 4*a* through 4*d* is kept at the washing speed $V_{11}$. At the same time, the running speed of the web 10 is further decreased from the washing speed $V_{11}$, to a predetermined stand-by speed $V_{12}$. Any stand-by speed $V_{12}$ lower than at least the washing speed $V_{11}$ suffices. Preferably, the stand-by speed $V_{12}$ is set to the slow-operating speed, more preferably, to at the minimum running speed of the web 10. Blanket wash is carried out for a predetermined time, but the higher the washing speed $V_{11}$, the shorter the washing time is.

After completion of the blanket wash, the running speed of the web 10 is again increased to the washing speed $V_{11}$, which is the rotation speed of the printing units 4*a* through 4*d*. The running speed of the web 10 is synchronized with the rotation speed of the printing units 4*a* through 4*d*, and the blanket cylinder is thrown on. After the the blanket cylinder is throw on, the running speed of the web 10 is again increased to the printing speed $V_{10}$, and printing is resumed.

By washing the blanket in the above method, it becomes possible to drive the web 10 more slowly and shorten the run length of the web 10 during the washing, as compared with a case where blanket wash is carried out while the web 10 is fed at the same speed as the rotation speed of the printing units 4*a* through 4*e* as before. It is also possible to increase the peripheral speed of the blanket cylinder than before, and keep the washing efficiency at a high level. As a result, it is possible to decrease the amount of spoilage generated when washing is carried out during printing.

When the washing solution having entered in the gap of the blanket cylinder is removed after the blanket cylinder has been washed, the machine is operated in an operation pattern as shown in FIG. 4. After completion of blanket wash, the rotation speed of the printing units 4*a* through 4*d* is further increased from the washing speed $V_{11}$. When the rotation speed of the printing units 4*a* through 4*d* reaches a predetermined washing solution removing speed $V_{13}$, the rotation speed of the printing units 4*a* through 4*d* is kept at the washing solution removing speed $V_{13}$ for a predetermined time. Any washing solution removing speed $V_{13}$ higher than at least the washing speed $V_{11}$ suffices, like the first embodiment. Preferably, the rotation speed of the printing units 4*a* through 4*d* is higher than the printing speed $V_{10}$. More preferably, the rotation speed of the printing units 4*a* through 4*d* is set at the maximum rotation speed therof.

Whereby, the washing solution having entered in the gap of the blanket cylinder flies out to the outside.

After a predetermined time has elapsed, the rotation speed of the printing units 4*a* through 4*d* is decreased to the washing speed $V_{11}$, whereas the running speed of the web 10 is increased from the stand-by speed $V_{12}$ to the washing speed $V_{11}$. The running speed of the web 10 is synchronized with the rotation speed of the printing units 4*a* through 4*d*, and the blanket cylinder is thrown on. After that, the speed of the web 10 is again increased, and printing is resumed.

By rotating the blanket cylinder at a high speed after completion of blanket wash, it is possible to remove the washing solution having entered in the gap of the blanket cylinder by centrifugal force, and decrease the amount of spoilage caused by the washing solution after printing is resumed. The above operation pattern may be realized in a controlling method similar to that according to the first embodiment, description of which is thus omitted.

Figure 5:
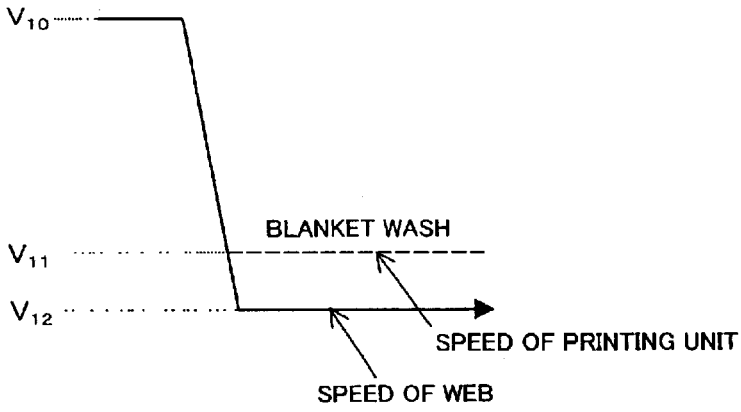
FIG. 5 is a time chart showing a modification of the operation pattern of the web offset printing press according to the second embodiment of this invention.

When the running speed of the web 10 is decreased from the printing speed $V_{10}$ to the stand-by speed $V_{12}$, there is set a temporary wait time at the washing speed $V_{11}$, as shown in FIGS. 3 and 4. However, the running speed of the web 10 may be linearly decreased from the printing speed $V_{10}$ to the stand-by speed $V_{12}$, as shown in FIG. 5. The blanket cylinder is thrown off when the running speed of the web 10 reaches the washing speed $V_{11}$, and blanket wash is started while the rotation speed of the printing units 4*a* through 4*d* is still kept at the washing speed $V_{11}$.

(C) Third Embodiment

Next, description will be made of a third embodiment of this invention with reference to FIGS. 6 through 11. A blanket washing method according to the third embodiment can be applied to a conventional commercial web offset printing press of a shaftless type like the first embodiment, description of the third embodiment will be made, referring to the printing press shown in FIG. 18 like the first embodiment. Each operation pattern to be described hereinafter can be realized in a controlling method similar to that in the first embodiment, practical description of the controlling method is thus omitted here.

Figure 6:
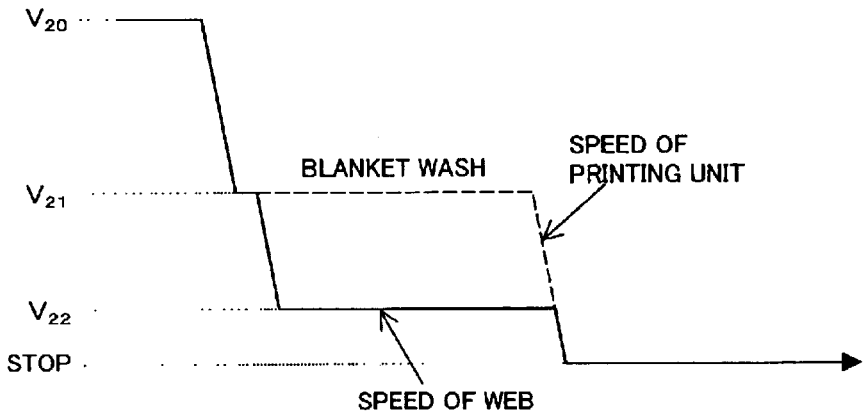
FIG. 6 is a time chart showing an operation pattern of the web offset printing press according to the second embodiment of this invention.

FIG. 6 is a time chart showing the blanket washing method according to the third embodiment, wherein the rotation speed of the printing units 4*a* through 4*d* and the running speed of the web 10 are changed with time. The running speed of the web 10 is shown by a solid line, whereas the rotation speed of the printing units 4*a* through 4*d* is converted to a running speed, and shown by a broken line in the drawings. An overlapped portion of the solid line and the broken line is shown by only the solid line. In the third embodiment, the blanket is washed after printing has been completed (after one job has been finished).

When receiving a printing finish command, the control units 34*a* through 34*d*, 33, 36, 37 and 38 give commands to the respective drive motors 24*a* through 24*d*, 23, 26, 27 and 28 to gradually decrease the running speed of the web 10 from the printing speed $V_{20}$, as show in FIG. 6. When the running speed of the web 10 reaches a predetermined washing speed (for example, 200 rpm) $V_{21}$, the blanket cylinder is thrown off. The washing speed $V_{21}$ may be set to the same speed as the washing speed $V_{11}$ in the second embodiment.

After the blanket cylinder has been thrown off, the washing solution is supplied and blanket wash is started while the rotation speed of the printing units 4*a* through 4*d* is kept at the washing speed $V_{21}$. At the same time, the running speed of the web 10 is further decreased from the washing speed $V_{21}$ to a predetermined stand-by speed $V_{22}$. Any stand-by speed $V_{22}$ lower than at least the washing speed $V_{21}$ suffices. Preferably, the stand-by speed $V_{22}$ is set to the slow operating speed, more preferably, to the minimum running speed of the web 10. Blanket wash is carried out for a predetermined time, but the higher the washing speed $V_{21}$, the shorter the washing time is. After completion of blanket wash, the rotation speed of the printing units 4*a* through 4*d* is decreased to the stopping state, and the running speed of the web 10 is also decreased to the stopping state, in agreement with the decreasing speed of the printing units 4*a* through 4*d*.

By washing in the above method, it is possible to rotate the blanket cylinder at a high peripheral speed while the running speed of the web 10 is decreased. This can keep a high washing efficiency and decrease the amount of spoilage generated when the washing is performed after completion of the printing. Incidentally, it is alternatively possible to continuously decrease the running speed of the web 10 to the stopping state after the blanket cylinder has been thrown off, thereby to provide the above effects, as well. In which case, there is a possibility that the washing solution intensively attaches to the same portion of the web 10 because the blanket wash is carried out while the web 10 is stopped. For this, it is preferable that the web 10 is not stopped but slowly operated during the blanket wash, as shown in FIG. 6. It is thereby possible to prevent the washing solution from intensively attaching to the same portion of the web 10, and preventing the web 10 from breaking.

Figure 7:
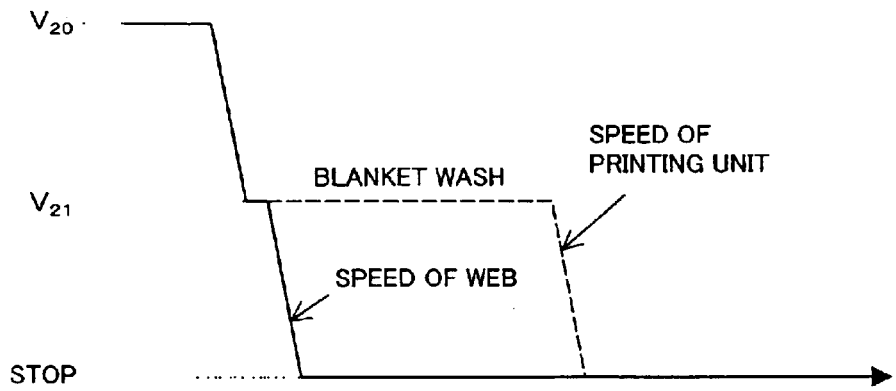
FIG. 7 is a time chart showing a modification of the operation pattern of the web offset printing press according to a third embodiment of this invention.

In FIGS. 6 and 7, a temporary wait time is provided at the washing speed $V_{21}$ when the running speed of the web 10 is decreased from the printing speed $V_{20}$ to the stand-by speed $V_{22}$ or the stopping state. Alternatively, the running speed of the web 10 may be linearly decreased from the printing speed $V_{20}$ to the stand-by speed $V_{22}$ or the stopping state, like the first embodiment (refer to FIG. 5).

Figure 8:
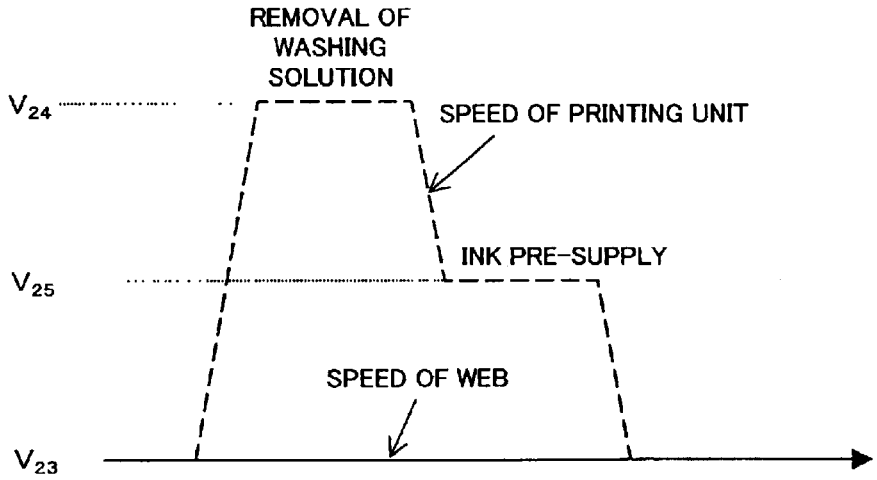
FIG. 8 is a time chart of an operation pattern of the web offset printing press according to the third embodiment of this invention.
Figure 9:
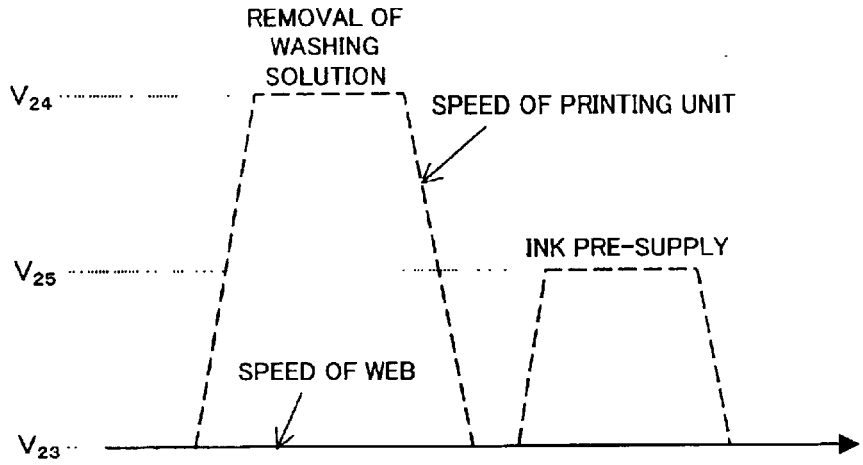
FIG. 9 is a time chart showing a modification of the operation pattern of the web offset printing press according to the third embodiment of this invention.
Figure 10:
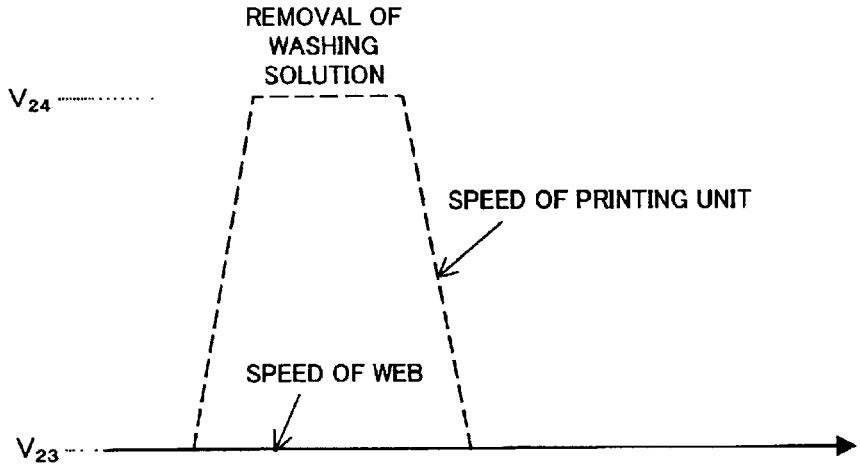
FIG. 10 is a time chart showing a modification of the operation pattern of the web offset printing press according to the third embodiment of this invention.

The blanket wash allows the washing solution to enter in the gap of the blanket cylinder. The process of removing the washing solution having entered in the gap is performed after the printing press is re-started and before the printing is started. In concrete, the washing solution removing process is performed in operation patterns as shown in FIGS. 8 through 10. In FIGS. 8 through 10, the running speeds of the web 10 is shown by a solid line, whereas the rotation speed of the printing units 4*a* through 4*d* is converted to a running speed and shown by a broken line. An overlapped portion of the solid line and the broken line is shown by only the solid line.

FIGS. 8 and 9 show operation patterns applied when the plate is changed after completion of printing. After the plate has been change, ink pre-supply (QSI) of preliminarily supplying ink in quantity according to the next pattern to the ink roller group is preferably performed before the printing is started. By performing the ink pre-supply in prior, it becomes possible to shorten a time for color adjustment (a time required for the adjusting process), and decrease spoilage generated at the time of adjustment by shortening the adjusting time.

First, the operation pattern in FIG. 8 will be described. The blanket cylinder is thrown off, with the web 10 running at a predetermined stand-by speed (a slow operating speed, preferably the minimum speed) $V_{23}$, and the rotation speed of the printing units 4*a* through 4*d* is increased without rest to the washing solution removing speed $V_{24}$. When the rotation speed of the printing units 4*a* through 4*d* reaches a predetermined washing solution removing speed $V_{24}$, the rotation speed is kept at the washing solution removing speed $V_{24}$ for a predetermined time. The washing solution removing speed $V_{24}$ is preferably higher than the printing speed, more preferably, is set at the maximum rotation speed of the printing units 4*a* through 4*d*. Whereby, the washing solution having entered in the gap of the blanket cylinder can be removed by centrifugal force. Accordingly, the amount of spoilage caused by the washing solution after the printing is resumed can be decreased.

After a predetermined time has elapsed, the rotation speed of the printing units 4*a* through 4*d* is decreased to a predetermined ink pre-supplying speed $V_{25}$. The above ink pre-supply is performed for a predetermined time while the rotation speed is kept at the ink pre-supplying speed $V_{25}$. After completion of the ink pre-supply, the rotation speed of the printing units 4*a* through 4*d* is decreased and synchronized with the running speed $V_{23}$ of the web 10, the blanket cylinder is thrown on, and the printing press shifts to the normal operation.

In the operation pattern shown in FIG. 9, a washing solution removing process is carried out at the washing solution removing speed $V_{24}$. After that, the rotation speed of the printing units 4*a* through 4*d* is temporarily decreased to the running speed $V_{23}$ of the web 10, again increased to the ink pre-supplying speed $V_{25}$, and the ink pre-supplying process is carried out. If the controlling method described in the first embodiment is employed, the drive motors 24*a* through 24*d* of the printing units 4*a* through 4*d* are controlled under the speed control at a fixed target speed when the washing solution removing process or the ink pre-supplying process is carried out. This speed control is a feed-back control. However, the control system of the printing presses has some control delay, so that an actual final rotation speed is deviated a little from a target speed. Additionally, a direction of the deviation differs between when the rotation speed reaches a target speed while increasing and when the rotation speed reaches a target speed while decreasing. For example, in the case of the operation pattern shown in FIG. 8, when an actual washing solution removing speed deviates from a target speed toward a larger value, an actual ink pre-supplying speed deviates from the target value toward a smaller value. When a direction of deviation differs at each speed as above, setting of a target speed is difficult in consideration of the deviation, thus the optimum rotation speed cannot be set. In the operation pattern shown in FIG. 9, the rotation speed is increased and reaches a target speed in the ink pre-supplying process, as done in the washing solution removing process. Whereby, it is possible to obtain the optimum rotation speed in each process. Incidentally, this operation pattern is unnecessary when the control delay is small. For the purpose of shortening the preparatory time or decreasing the spoilage, the operation pattern shown in FIG. 8 is more preferable.

FIG. 10 shows an operation pattern applied when the printing is resumed without a plate change in the same job. Since distribution of quantities of ink on the ink roller group can remain unchanged when the plate is not changed, the above ink pre-supplying process is unnecessary. In this case, the rotation speed of the printing units 4*a* through 4*d* is increased to the washing solution removing speed $V_{24}$ to remove the washing solution having entered in the gap of the blanket cylinder. After a predetermined time has elapsed, the rotation speed of the printing units 4*a* through 4*d* is decreased and synchronized with the running speed $V_{23}$ of the web 10, the blanket cylinder is thrown on, and the printing press is shifted to the normal operation.

Meanwhile, the drier unit 5 of the web offset printing press stops its operation when the web 10 is stopped due to completion of printing. When the printing is resumed, it is necessary to perform a drier temperature increasing process of again heating the drier unit 5 and increasing its temperature, along with the above washing solution removing process and the ink pre-supplying process. The web 10 is required to run at a low speed during the drier temperature increasing process in order to prevent the web 10 from being overheated. Since the web 10 and the printing units 4*a* through 4*d* can be separately operated in the printing press according to this invention, the washing solution removing process and the ink pre-supplying process can be carried out in parallel to the drier temperature increasing process.

Figure 11:
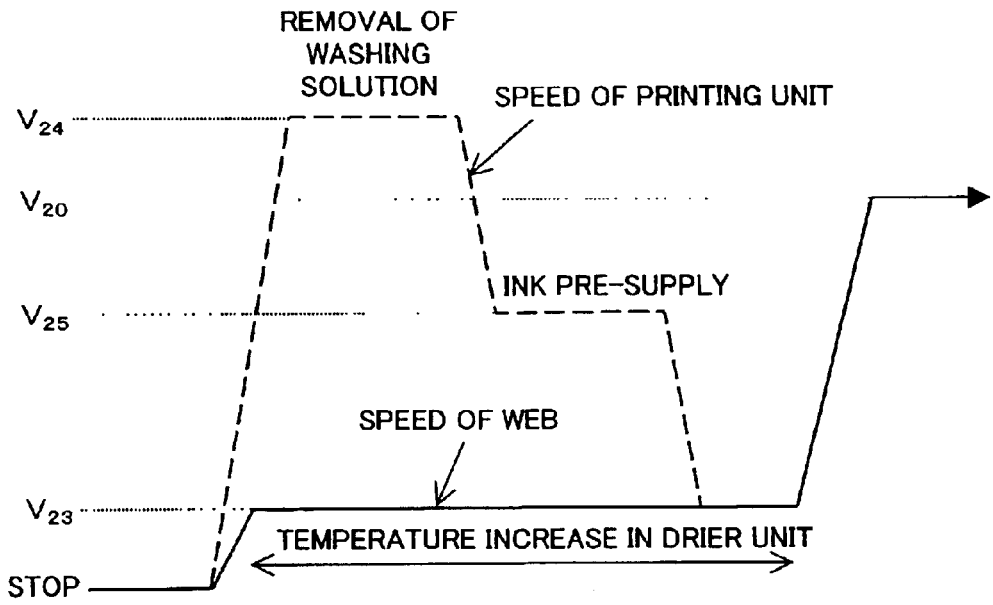
FIG. 11 is a time chart showing a modification of the operation pattern of the web offset printing press according to the third embodiment of this invention.

FIG. 11 shows an example of an operation pattern applied when the washing solution removing process followed by ink preparatory supply is carried out in parallel to the drier temperature increasing process. When the web 10 is stopped, the blanket cylinder is thrown off, and the running speed of the web 10 is increased to the stand-by speed $V_{23}$. On the other hand, the rotation speed of the printing units 4*a* through 4*d* is increased to the washing solution removing speed $V_{24}$ without rest. Re-heating of the drier unit 5 is resumed while the running speed of the web 10 is kept at the stand-by speed $V_{23}$, and the drier temperature increasing process is carried out. During this, the rotation speed of the printing units 4*a* through 4*d* is kept at the washing solution removing speed $V_{24}$ for a predetermined time, and the washing solution removing process is carried out. After the predetermined time has elapsed, the rotation speed of the printing units 4*a* through 4*d* is decreased to the ink pre-supplying speed $V_{25}$, and the ink pre-supply is carried out. After completion of the ink pre-supply, the rotation speed of the printing units 4*a* through 4*d* is synchronized with the running speed $V_{23}$ of the web 10, and the blanket cylinder is thrown on. When the temperature of the drier unit 5 has been increased, the speeds of the web 10 and the printing units 4*a* through 4*d* are started to be increased. By carrying out the washing solution removing process and the ink pre-supply in parallel to the drier temperature increasing process, the setup time before printing is started can be shortened, and spoilage generated during the setup time can be reduced.

(D) Fourth Embodiment

Next, description will be made of a fourth embodiment of this invention with reference to FIGS. 12 and 13. A web offset printing press according to this embodiment has guide units 123 disposed on the upstream side of the first printing unit 4*a*, on the downstream side of the last printing unit 4*d*, and at each intermediate position between two printing units 4*a* through 4*d*, in addition to the structure of the conventional commercial web offset printing press of a shaftless type shown in FIG. 18. In other words, the guide units 123 are disposed on the upstream side and the down stream side of each blanket cylinder in the running path of the web 10.

Figure 12:
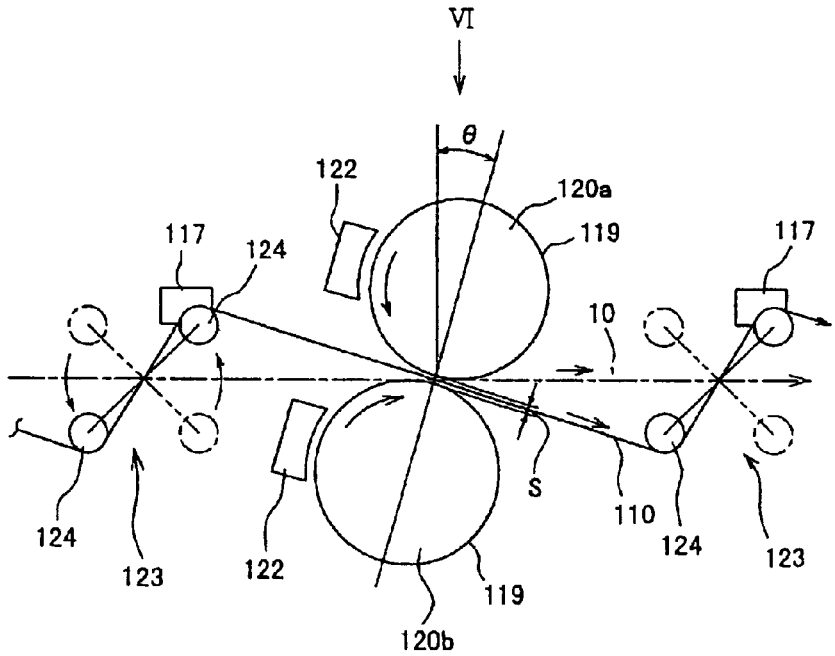
FIG. 12 is a schematic side view of a printing unit of a web offset printing press according to a fourth embodiment of this invention, with essential parts thereof enlarged.
Figure 13:
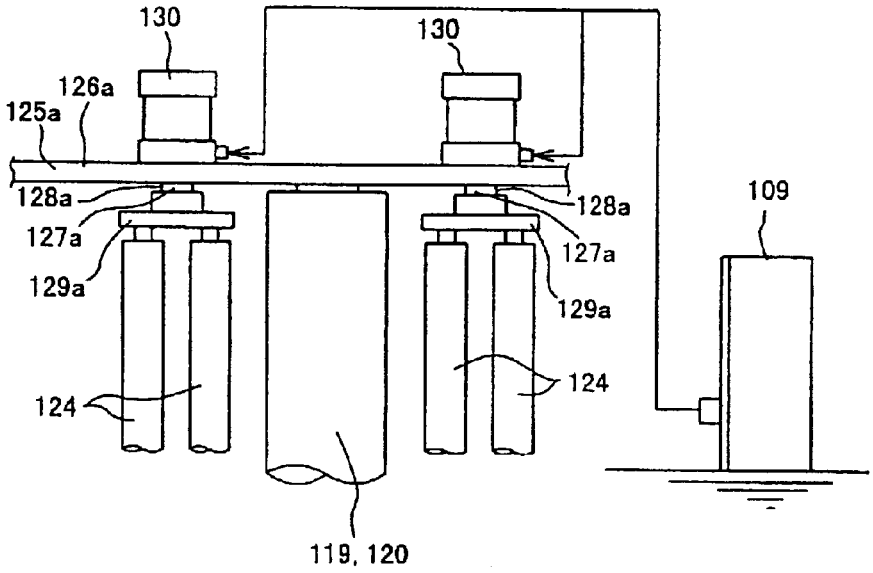
FIG. 13 is a partial plan view of a printing unit in the direction of an arrow VI in FIG. 12, with a web and a blanket automatic washing unit omitted.

As shown in FIGS. 12 and 13, each of the guide units 123 comprises a bracket 126*a* or 126*b* attached to a frame 125*a* or 125*b*, which is positioned on the both sides of the printing unit, a fulcrum shaft 128*a*or 128*b* rotatably supported by the a bracket 126*a*, 126*b* via a bearing 127*a* or 127*b*, an arm 129*a* or 129*b* fixed to the fulcrum shaft 128*a* or 128*b*, a pair of guides 124, each of which attached to the arm 129*a* or 129*b*, provided on both the upper side and the lower side of the web 10, which extend along the direction of the width of the web 10, a rotary actuator 130 disposed at the end of the shaft of the fulcrum shaft 128*a* or 128*b* to swing the guide 124, and a stopper 117 restricting the position of a swinging end of the guide 124. The guide 124 is formed with rollers or bars (bar-like members), which is laid along the transversal direction of the entire unit (the direction along the width of the web 10). As shown in FIG. 13, the pair of guides 124 is away from the web 10 when printing is carried out. By raising or lowering the guides 124, it is possible to change the running path of the web 10. Incidentally, FIG. 13 shows only the left side of the printing press (on the back side of the paper of FIG. 12), thus showing only the frame 125*a*, the bracket 126*a*, the bearing 127*a*, the fulcrum shaft 128*a*, and the arm 129*a*. However, the frame 125*b*, the bracket 126*b*, the bearing 127*b*, the fulcrum shaft 127*b* and the arm 129*b* not shown are similarly disposed on the right side the printing press.

The both ends of each of the guides 124 are attached to the arms 129*a* and 129*b* (both-ends attached structure). Alternatively, one end of the guide 124 may be attached to the arm 129*a* or 129*b* (single-end attached structure). The rotary actuator 130 functions as a shaft rotating means. The rotary actuator 130 may have a mechanism formed by combining a link with an air cylinder or a hydraulic cylinder, other than the above shown. The stopper 117 sets a positional relationship among the blanket cylinders 120*a* and 120*b*, and the web 10, the position of which is adjustable. The web guide unit 123 is here a rotating means, but the web guide unit 123 may be formed in any one of various methods, or have another structure. For example, the web guide unit 123 may independently raise and lower the guide 124 by air cylinders.

In the printing press which prints on both surfaces of the web 10, the blanket cylinders 120*a* and 120*b* of the printing unit 4, which are disposed on the upper and lower sides of the web path line, are generally disposed at a predetermined angle θ to the perpendicular line as shown in FIG. 12, not perpendicularly arranged on the both sides of the web. The reason of this is that the running web 10 is allowed to contact with the blanket cylinders 120*a* and 120*b* at a predetermined wind angle. Whereby, the web 10 can be conveyed stably and surely, which allows improvement in printing quality. An angle θ between the blanket cylinders 120*a* and 120*b* allows to form a predetermined gap S between the blanket cylinders 120*a* and 120*b* thrown off.

In the washing operation, the rotary actuators 130 of the guide units 123 are operated to swing the guides 124, thereby bringing the guides 124 into contact with the stoppers 117. Whereby, the running path of the web 10 is changed so as to be positioned within the gap S. Namely, the running path of the web 10 is suitably changed during the washing operation to decrease the contact of the web 10 with the both blanket cylinders 120*a* and 120*b*, or to guide the web 10 in a tangential direction common to the both blanket cylinders 120*a* and 120*b*, thereby allowing the web 10 to pass through between the upper and lower blanket cylinders 120*a* and 120*b* without a contact therewith.

In this embodiment, the blanket washing process or the blanket washing solution removing process can be performed in similar operation patterns to those described in the first to third embodiments. According to this embodiment, the web guide unit 123 is provided. In the washing process or the washing solution removing process on the blankets 119 provided on the outer peripheral surfaces of the blanket cylinders 120*a* and 120*b*, the rotary actuators 130 are driven through the control unit 109 to move the arms 129, so that the arms 129 are shifted to positions denoted by solid lines in FIG. 12. The web 10 is thereby brought into a state where the contact of the web 10 with the blanket cylinders 120*a* and 120*b* positioned above and below the web path line is decreased, or the web 10 does not contact with the blanket cylinders 120*a* and 120*b* while a predetermined tension is acting thereon. While the contact of the web 10 with the blanket cylinders 120*a* and 120*b* has been decreased, or the web 10 is not contact with the blanket cylinders 120*a* and 120*b*, the blankets 119 are washed by automatic washing units 122, and the washing solution on the blanket cylinders 120*a* and 120*b* is removed at a high speed.

According to this embodiment, it is possible to set that the contact of the web 10 passed through between the blankets 120*a* and 120*b* with the same is decreased, or that the web 10 is not contact with the blankets 120*a* and 120*b*, so that the possibility of paper ripping (breaking of paper) is decreased. Since the possibility of paper breaking is extremely small, it is possible to stop convey of the web 10 when the washing process or the washing solution removing process on the blankets 119 is performed, which can remarkably decrease the amount of spoilage.

(F) Others

As having been described the first to fourth embodiments of this invention, the present invention is not limited to the above embodiments. The present invention may be modified in various ways without departing from the scope of the invention. The operation patterns shown in FIGS. 1 through 11 are merely practical examples of the embodiments. With respect to the blanket washing process, other various operation patterns are possible so long as the blanket is washed while the blanket cylinder is rotated independently of the running of the web, with the blanket cylinder thrown off. With respect to the blanket washing solution removing process, other various operation patterns are possible so long as the blanket cylinder is rotated independently of the running of the web, with the blanket cylinder thrown off, after the blanket has been washed, thereby removing the washing solution attached to the blanket.

Figure 14:
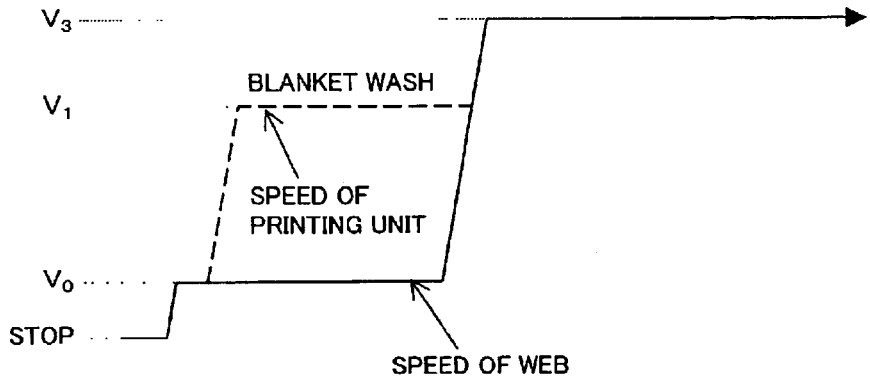
FIGS. 14(*a*) and 14(*b*) are time charts showing modifications of the operation pattern in FIG. 1.
Figure 14:
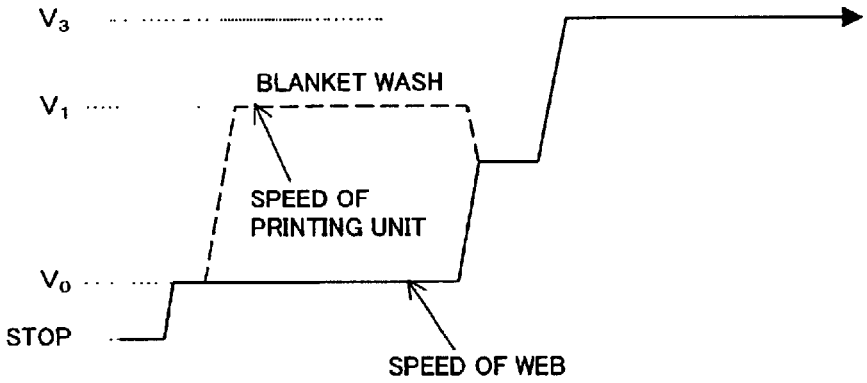

When the blanket is washed before printing is started, for example, the rotation speed of the printing units 4*a* through 4*d* is decreased to the stand-by speed $V_0$, which is the running speed of the web 10, to synchronize the speeds after the washing is completed in the first embodiment, as shown in FIG. 1. Alternatively, the rotation speed of the printing units 4*a* through 4*d* maybe synchronized with the running speed of the web 10 during the course that the running speed of the web 10 is increased to the printing speed $V_3$, as show in FIG. 14(*a*). Still alternatively, it is possible that the running speed of the web 10 is increased to a speed close to the washing speed $V_1$, the rotation speed of the printing units 4*a* through 4*d* is slightly decreased and synchronized with the running speed of the web 10, after that, the rotation speed is increased to the printing speed $V_3$, as shown in FIG. 14(*b*). If the speed synchronization after completion of the washing is performed as above, it becomes possible to eliminate waste of the deceleration time.

Figure 15:
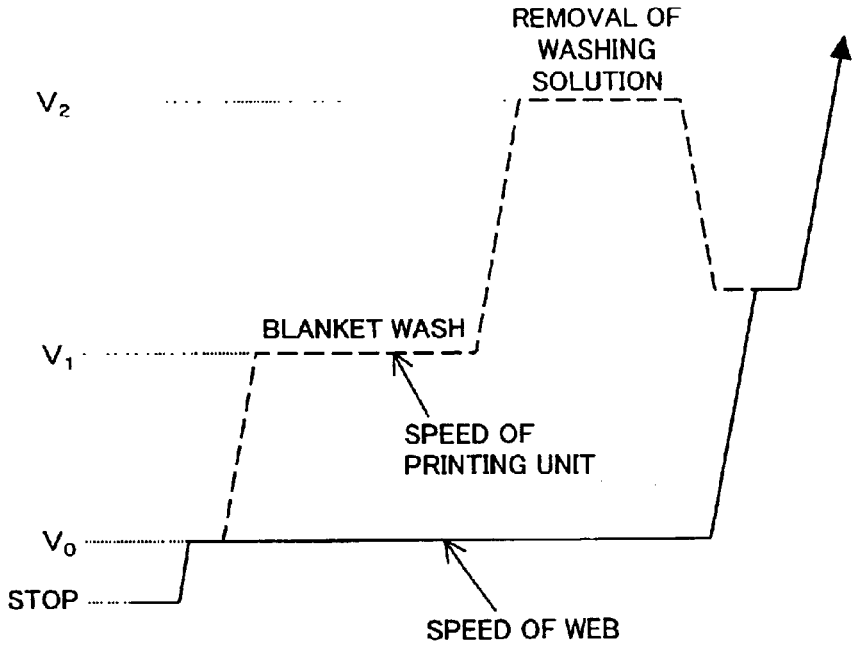
FIGS. 15(*a*) and 15(*b*) are time charts showing modifications of the operation pattern in FIG. 2.
Figure 15:
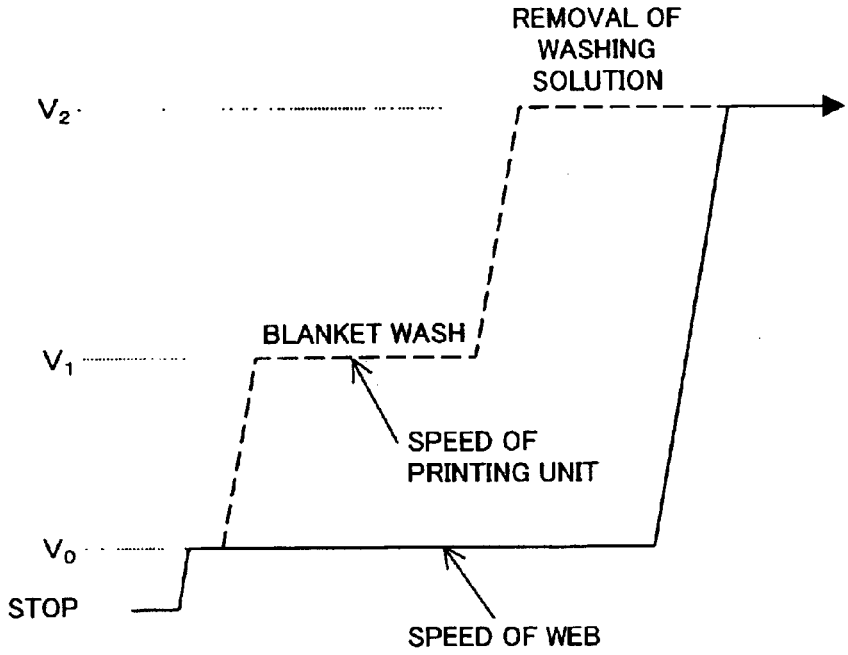

After completion of the washing solution removing process, it becomes possible that the rotation speed of the printing units 4*a* through 4*d* may be synchronized with the running speed of the web 10, with the running speed of the web 10 increased to a certain speed as shown in FIG. 15(*a*), not that the rotation speed of the printing units 4*a* through 4*d* is decreased to the stand-by speed $V_0$, which is the running speed of the web 10, and synchronized with the running speed of the web 10 as shown in FIG. 2. When the washing solution removing speed $V_2$ is equal to the printing speed as shown in FIG. 15(*b*), the running speed of the web 10 may be increased to the printing speed $V_2$, and synchronized with it.

Figure 16:
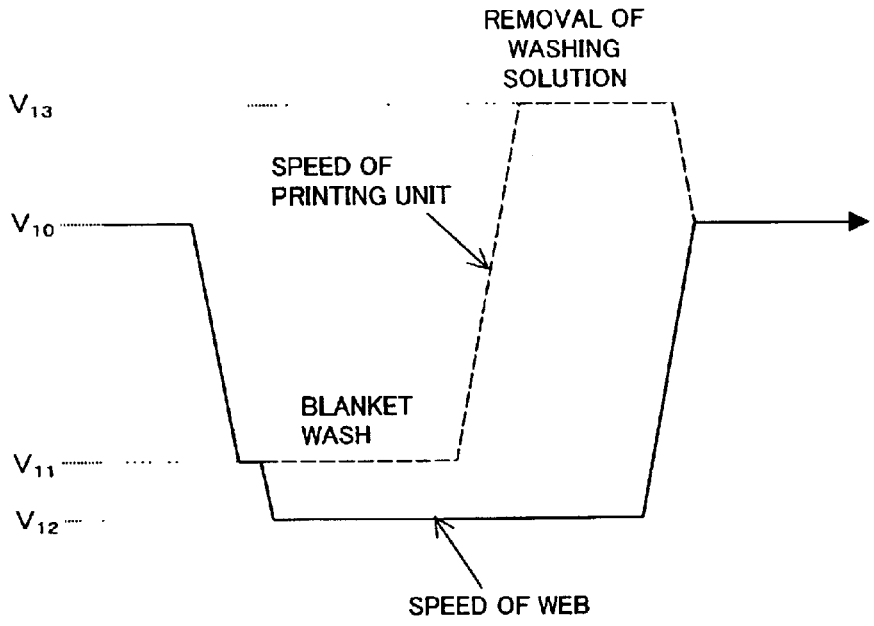
FIG. 16 is a time chart showing a modification of the operation pattern in FIG. 4.

When blanket wash and the washing solution removing process are both carried out during printing, the speeds are synchronized at the washing speed $V_{11}$ after completion of the washing solution removing process in the second embodiment, as shown in FIG. 4. Alternatively, the speeds may be synchronized at the printing speed $V_{10}$, as shown in FIG. 16. If the speeds are synchronized in the above manner after the washing solution removing process, it becomes possible to decrease a quantity of deceleration of the printing units 4*a* through 4*d*, and eliminate waste of the deceleration time.

Figure 17:
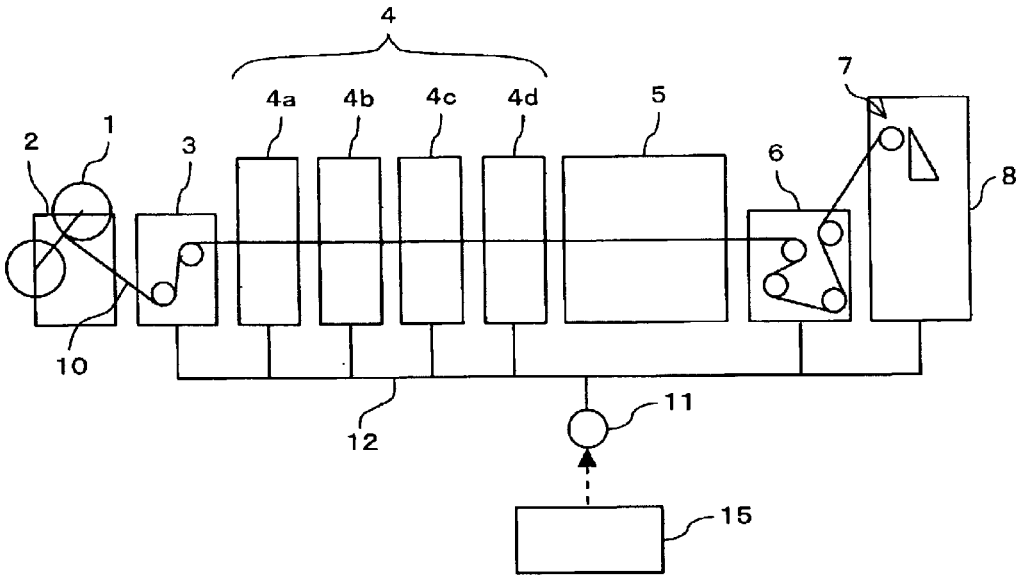
FIG. 17 is a schematic diagram showing a structure of a known web offset printing press of a line shaft type.
Figure 19:
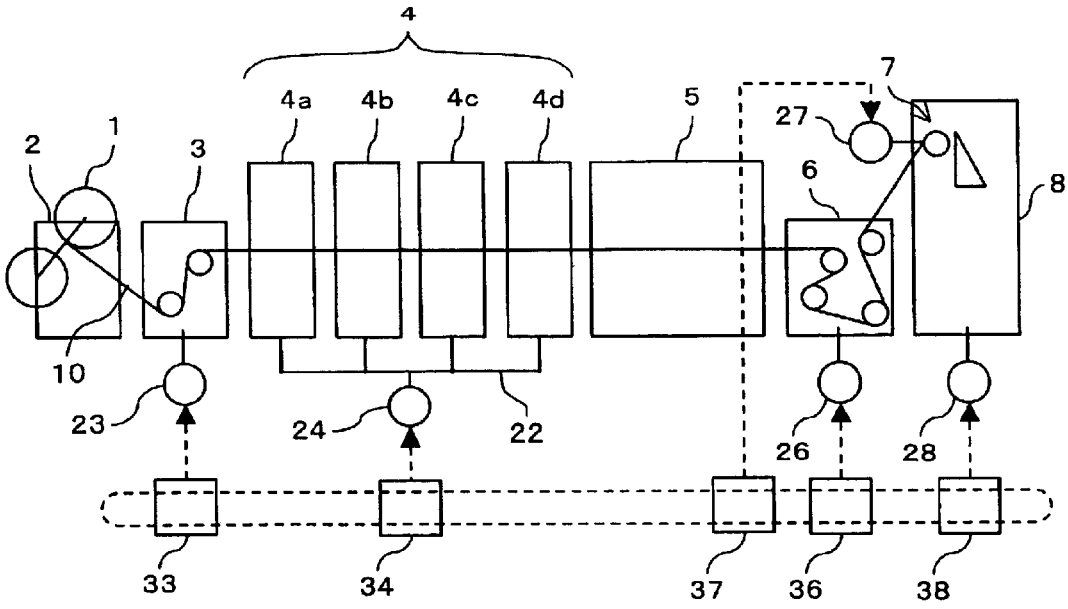
FIG. 19 is a schematic diagram showing a structure of a known web offset printing press of a shaftless type.

In the above embodiments, the present invention is applied to the known shaftless machine shown in FIG. 18. However, the shaftless machines is merely one example to which the present invention can be applied, thus application of the present invention is not limited to the printing press having the structure shown in FIG. 18. For example, the present invention can be applied to the shaftless machine in a type shown in FIG. 19. The operation patterns shown in FIGS. 1, 2, 14(*a*), 14(*b*), 15(*a*) and 15(*b*), and the operation patterns shown in FIGS. 8, 9 and 10 can be also applied to the shaft machine shown in FIG. 17. In detail, clamping devices (paper holding rollers or the like) for clamping the web 10 are disposed on the upper stream side of the front printing unit 4*a* and the down stream side of the last printing unit 4*d* to fix the web 10, with the web 10 stretched. In this case, the web 10 is stopped, whereas only the printing units 4*a* through 4*d* idle. Alternatively, variable speed change gears may be interposed between the line shaft 12 and the respective printing units 4*a* through 4*d* to rotate the printing units 4*a* through 4*d* at different speeds from the running speed of the web 10, whereby the other operation pattern can be applied.

What is claimed is:

1. A web offset printing press for printing on a web, comprising:

a printing unit including a blanket cylinder with a blanket mounted thereon, the blanket cylinder having its peripheral speed controlled separately from a running speed of the web; and a control unit which controls automated operation of the printing press in such a manner that the blanket cylinder is disengaged from the web, and that, with the web being kept running, the blanket mounted on a surface of the blanket cylinder is washed while the blanket cylinder is rotating at a peripheral speed higher than the speed of the web, wherein the speed of the web is lower than a printing speed.

2. A web offset printing press as set forth in claim 1, wherein, during the automated operation, said control unit performs controlling in such a manner that the blanket cylinder is disengaged from the web during or after increasing of the running speed of the web, from a halt state to a predetermined stand-by speed, and that the blanket is washed while the blanket cylinder is rotating at a predetermined washing speed higher than the stand-by speed, and that the peripheral speed of the blanket cylinder is reduced to the stand-by speed after completion of washing the blanket, and that the blanket cylinder is restored, and that the running speed of the web is increased to a predetermined printing speed.

3. A web offset printing press as set forth in claim 2, wherein, during the automated operation, said control unit: performs controlling in such a manner that, after completion of washing the blanket, the blanket cylinder is rotated at a peripheral speed higher than a peripheral speed at which the blanket cylinder is rotated during washing of the blanket to remove washing solution left on the blanket before the blanket cylinder is restored.

4. A web offset printing press as set forth in claim 3, further comprising a drier unit for applying heat onto the web, on which printing has been performed, to dry the web, wherein, during the automated operation, said control unit performs controlling in such a manner that the removal of the washing solution is performed in parallel to a drier temperature increasing process of increasing a temperature of the drier unit, while the web is running at a predetermined stand-by speed.

5. A web offset printing press as set forth in claim 1, wherein, during the automated operation, said control unit performs controlling in such a manner that the blanket cylinder is disengaged from the web while the running speed of the web decreased from a predetermined printing speed to a predetermined stand-by speed, and that the blanket is washed while the blanket cylinder is rotating at a predetermined washing speed higher than the stand-by speed, and that the peripheral speed of the blanket cylinder is synchronized with the running speed of the web after completion of washing the blanket, and that the blanket cylinder is restored, and that the running speed of the web is again increased to the printing speed.

6. A web offset printing press as set forth in claim 5, wherein, during the automated operation, said control unit performs controlling in such a manner that, after completion of washing the blanket, the blanket cylinder is rotated at a peripheral speed higher than a peripheral speed at which the blanket cylinder is rotated during washing of the blanket to remove washing solution left on the blanket before the blanket cylinder is restored.

7. A web offset printing press as set forth in claim 6, further comprising a drier unit for applying heat onto the web, on which printing has been performed, to dry the web, wherein, during the automated operation, said control unit performs controlling in such a manner that the removal of the washing solution is performed in parallel to a drier temperature increasing process of increasing a temperature of the drier unit, while the web is running at a predetermined stand-by speed.

8. A web offset printing press as set forth in claim 1, wherein, during the automated operation, said control unit performs controlling in such a manner that the blanket cylinder is disengaged from the web while the running speed of the web decreases from a predetermined printing speed to a halt state, and that the blanket is washed while the blanket cylinder rotating at a predetermined washing speed, and that the peripheral speed of the blanket cylinder is reduced to the halt state after completion of washing the blanket.

9. A web offset printing press as set forth in claim 8, wherein, during the automated operation, said control unit performs controlling in such a manner that the running speed of the web is reduced to a predetermined stand-by speed after the blanket cylinder is disengaged from the web, and that the running speed of the web is reduced to the halt state after completion of washing the blanket.

10. A web offset printing press as set forth in claim 1, further comprising guide means disposed on an upper stream side and a lower stream side of the blanket cylinder in a running path of the web, said guide means changing the running path of the web to reduce or get rid of contact of the web with the blanket cylinder while the blanket is being washed.

11. A web offset printing press as set forth in claim 10, wherein, the web is stopped running when the blanket is washed.

12. A web offset printing press as set forth in claim 1, wherein, during the automated operation, said control unit performs controlling in such a manner that the web is clamped by giving a tension thereto, and that the blanket is washed while the blanket cylinder is idling with respect to the web thus being clamped.

13. A web offset printing press for printing on a web, comprising:

a printing unit including a blanket cylinder with a blanket mounted thereon, the blanket cylinder having its peripheral speed controlled separately from a running speed of the web; and a control unit which controls automated operation of the printing press in such a manner that, after washing of the blanket which has been disengaged from the web, the blanket cylinder is rotated at a peripheral speed higher than a running speed of the web, with the blanket cylinder being kept disengaged from the web and with the web being kept running, to remove washing solution left on the blanket.

14. A web offset printing press as set forth in claim 13, wherein, during the automated operation, said control unit performs controlling in such a manner that the blanket cylinder is rotated at a peripheral speed higher than a maximum peripheral speed the blanket cylinder reaches during an print operation, so as to remove the washing solution left on the blanket.

15. A web offset printing press as set forth in claim 14, wherein, during the automated operation, said control unit performs controlling in such a manner that the removal of the washing solution left on the blanket is performed while the web is running at a predetermined stand-by speed.

16. A web offset printing press as set forth in claim 15, further comprising a drier unit for applying heat onto the web, on which printing has been performed, to dry the web, wherein, during the automated operation, said control unit performs controlling in such a manner that the removal of washing solution left on the blanket is performed in parallel to a drier temperature increasing process of increasing a temperature of the drier unit, while the web is running at a predetermined stand-by speed.

17. A web offset printing press as set forth in claim 13, wherein, during the automated operation, said control unit performs controlling in such a manner that the removal of the washing solution left on the blanket is performed while the web is running at a predetermined stand-by speed.

18. A web offset printing press as set forth in claim 17, further comprising a drier unit for applying heat onto the web, on which printing has been performed, to dry the web, wherein, during the automated operation, said control unit performs controlling in such a manner that the removal of washing solution left on the blanket is performed in parallel to a drier temperature increasing process of increasing a temperature of the drier unit, while the web is running at a predetermined stand-by speed.

19. A web offset printing press as set forth in claim 13, further comprising guide means disposed on an upper stream side and a lower stream side of the blanket cylinder in a running path of the web, said guide means changing the running path of the web to reduce or get rid of contact of the web with the blanket cylinder during the removal of the washing solution left on the blanket.

20. A web offset printing press as set forth in claim 19, wherein the web is stopped running when the removal of the washing solution is performed.

21. A web offset printing press as set forth in claim 13, wherein, during the automated operation, said control unit performs controlling in such a manner that the web is clamped by giving a tension thereto, and that the removal of the washing solution left on the blanket is performed while the blanket cylinder is idling with respect to the web thus being clamped.

* * * * *